US006227558B1

(12) United States Patent
Arduin et al.

(10) Patent No.: US 6,227,558 B1
(45) Date of Patent: May 8, 2001

(54) INTERFACE DEVICE BETWEEN A SKI AND THE ELEMENTS FOR RETAINING A BOOT ON THE SKI

(75) Inventors: Joël Arduin, Metz-Tessy; Christian Huyghe, Gruffy; Axel Phelipon, Duingt; Pierre Szafranski, Metz-Tessy, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/258,157

(22) Filed: Feb. 26, 1999

(30) Foreign Application Priority Data

Feb. 27, 1998 (FR) ..... 98 02868

(51) Int. Cl.[7] ..... A63C 9/00
(52) U.S. Cl. ..... 280/611; 280/635
(58) Field of Search ..... 280/611, 601, 280/607, 610, 616, 617, 618, 623, 624, 633, 635, 609

(56) References Cited

U.S. PATENT DOCUMENTS

| | | | |
|---|---|---|---|
| 2,260,057 | 10/1941 | Rydberg | 280/611 |
| 2,268,449 | 12/1941 | Gruppe | 280/611 |
| 2,450,526 | 10/1948 | Scheider | 280/611 |
| 2,793,869 | 5/1957 | Braun | 280/611 |
| 4,022,491 | 5/1977 | Powell | 280/618 |
| 4,097,061 | 6/1978 | Dietlein | 280/607 |
| 4,627,636 | 12/1986 | Payraud | 280/607 |
| 5,199,734 | 4/1993 | Mayr | 280/602 |
| 5,221,105 | 6/1993 | Mayr et al. | 280/633 |
| 5,338,051 | 8/1994 | Szfranski et al. | 280/607 |
| 5,393,086 | 2/1995 | Le Masson et al. | 280/602 |
| 5,397,150 | 3/1995 | Commier et al. | 280/607 |
| 5,871,223 | 2/1999 | Zanco | 280/607 |
| 5,944,336 | 8/1999 | Fagot | 280/607 |
| 5,984,345 | 11/1999 | Carter | 280/633 |

FOREIGN PATENT DOCUMENTS

| | | |
|---|---|---|
| 68/90 | 4/1994 | (AT) . |
| 503503 | 4/1971 | (CH) . |
| 2135450 | 4/1972 | (DE) . |
| 2259373 | 6/1974 | (DE) . |
| 3717108 | 11/1987 | (DE) . |
| 3932438 | 4/1990 | (DE) . |
| 4112299 | 12/1991 | (DE) . |
| 0267130 | 5/1988 | (EP) . |
| 0490043 | 6/1992 | (EP) . |
| 0577947 | 1/1994 | (EP) . |
| 0755703 | 1/1997 | (EP) . |
| 2659865 | 9/1991 | (FR) . |
| WO 93/12845 | 7/1993 | (WO) . |
| WO 96/28225 | 9/1996 | (WO) . |
| WO 96/35488 | 11/1996 | (WO) . |
| WO 99/38583 | 8/1999 | (WO) . |

*Primary Examiner*—J. J. Swann
*Assistant Examiner*—J. Allen Shirver
(74) *Attorney, Agent, or Firm*—Greenblum & Bernstein, P.L.C.

(57) ABSTRACT

A ski equipped with an interface device having a plate that is kept raised above the upper surface of the ski with a front portion, a rear portion, and a non-extensible linkage. The ski has in its middle sliding skid zone a zone where its two lateral side edges are substantially parallel, each of the portions of the plate being connected to the ski via two lower wings that extend beneath the plate, both wings being pressed against the lateral side edges of the ski, and each wing being fixed to the ski via a single binding journal element. The invention also is directed to an interface device and a ski considered separately.

28 Claims, 7 Drawing Sheets

INTERFACE DEVICE BETWEEN A SKI AND THE ELEMENTS FOR RETAINING A BOOT ON THE SKI

BACKGROUND OF THE INVENTION

1. Field of the Invention

The present invention relates to an interface device between a ski and the elements for retaining a boot on the ski.

The invention also relates to an assembly for retaining a boot on a ski having the interface device, as well as to a ski having the interface device.

2. Description of Background and Relevant Information

International Patent Publication No. WO 96/35488 discloses an interface device having an elongated plate on which the two retaining elements are mounted. The plate is raised with respect to the ski. It is connected to the ski in its middle part via two projections whose distance can be adjusted. In addition, a shock absorbing element is wedged between each end of the plate and the ski.

Such a device generates greater concentrations of pressure in the middle zone of the ski. In addition, since both retaining elements are mounted on the same plate that is separate from the beam of the ski, the ski is freed of the stresses generated by the boot retaining elements.

This interface device provides satisfactory results because it allows the ski to bend naturally, and in a turn, the ski follows its trajectory along a normal curve. However, at high speeds, the ski is subject to a certain amount of floating because the plate is retained on the ski only over a short length. Furthermore, towards the front and rear, the ski is freed over a greater length than a traditional ski, and this is due, in fact, to the linking method of the plate. As a result, this makes the ski more sensitive to the vibrations caused by the relief of the terrain, and the plate acts like an insulating device between the boot and the ski.

SUMMARY OF THE INVENTION

An object of the invention is to provide an interface device of this type that improves the conditions in which the boot steers the ski, particularly providing a more fluid steering of the ski when there are alternately large and small curves to be taken.

Another object of the invention is to provide an interface device that frees the ski further in the area of its sliding surface.

Other objects and advantages of the invention will become apparent in the course of the following description.

The interface device according to the invention has a plate including a front portion with a mounting zone provided for a front retaining element, a rear portion with a mounting zone provided for a rear retaining element, and a non-extensible linkage between the two front and rear portions. For each portion and on each side, it has a lower wing that is set back with respect to the end of the plate portion, the wing being designed to be pressed against a lateral side edge of the ski, and for each wing a single journal element for binding the wings to the ski.

In its middle sliding surface zone, the ski according to the invention has a zone where its lateral side edges are substantially parallel and, in such zone, each of the lateral side surfaces of the ski has two openings or two series of openings provided for a journal binding element.

The ski equipped with the interface device has a plate that is spaced above the upper surface of the ski, including a front portion with a mounting zone provided for a front retaining element, a rear portion with a mounting zone provided for a rear retaining element, and a non-extensible linkage between the two front and rear portions. In its central sliding surface zone, the ski has a zone where both its lateral side edges are substantially parallel; each of the plate portions is connected to the ski via two lower wings that extend beneath the plate, and set back with respect to the end of the plate portion; the two wings are pressed against the lateral side edges of the ski; and each wing is fixed to the ski via a single binding journal element.

BRIEF DESCRIPTION OF THE DRAWINGS

The invention will be better understood with reference to the following description and to the annexed drawings that form an integral part thereof, whereby.

DETAILED DESCRIPTION OF THE INVENTION

Figure 1:
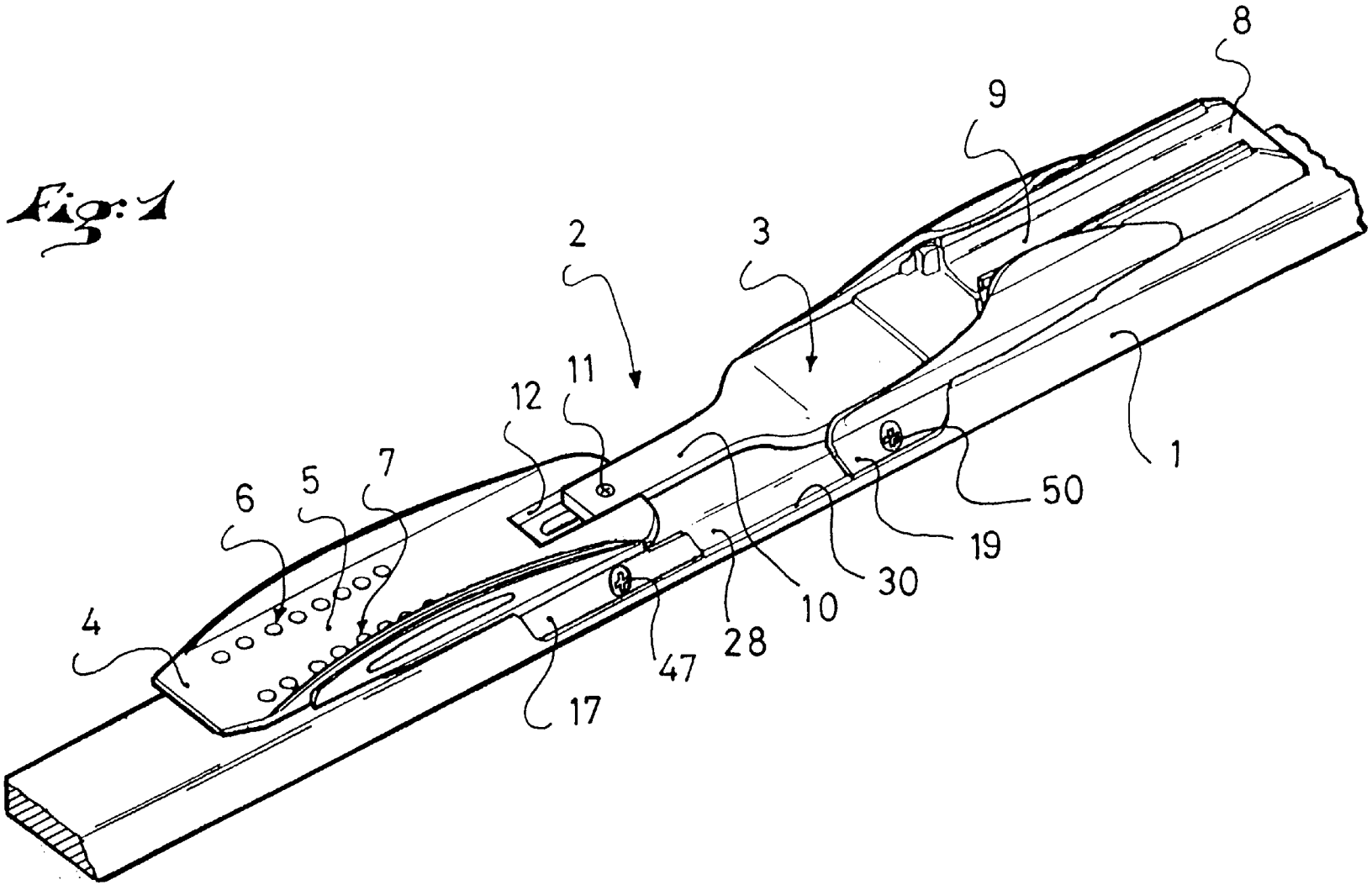
FIG. 1 is a perspective view of a first embodiment of the interface device according to the invention, mounted on the middle zone of a ski.

FIG. 1 represents the median part of a ski 1 that is topped with an interface device 2 obtained according to a first embodiment of the invention.

The device has an elongated plate 3, or plate assembly, that extends above the ski, along the longitudinal direction defined by the ski. The plate length is provided such that the plate supports the boot and both of the building, or retaining elements, for the boot on the ski.

The plate 3 has a stiff front portion 4 which has on its upper surface a mounting zone 5 provided for a front retaining element. This element is adapted to retain the front end of a boot; it is of a known type and is not described in greater detail herein. Preferably, as can be seen from FIG. 1, the mounting zone 5 has two series of openings 6 and 7 that are provided for the assembly screws of the front retaining element. These openings allow the front element to be mounted in a variety of longitudinal positions that depend on the length of the boot. In a variation, the mounting zone 5 can also be a rail system provided to receive the front retaining element along with a longitudinal latching device. Any other equivalent construction would also suffice.

The plate 3 also has a stiff rear portion 8, with a mounting zone 9 provided for a rear retaining element. This element is also of a known type and is not detailed herein.

Both plate portions can be obtained from any appropriate material, for example, plastic, reinforced or non-reinforced with fibers.

The two plate portions 4 and 8 are connected via a non-extensible connection 10. For example, as represented in FIG. 1, this linkage can be formed by a tongue having a reduced width, originating from the first portion and assembled to the other portion via a screw 11 or any other appropriate means. Preferably, the end of the tongue is slidably housed in a groove 12 that enables the total distance of the plate to be adjusted. That is, the linkage opposes extension movement between the two plate portions 4 and 8, but allows a contractive movement therebetween, i.e., the linkage can be said to comprise a contractive, non-extensible linkage or connection.

This is not restrictive. The linkage may equally well disallow such an adjustment. It can also be formed by a cable or a median portion that continuously connects the two front and rear portions of the plate. It can also be formed by an attached blade, each of whose ends is fixed to a portion of the plate.

The non-extensible nature of the linkage is important. It is thought that in a vertical and longitudinal plane, stiffness in bending is optional. In other words, the linkage could be flexible and non-extensible.

Both plate portions are kept raised above the ski. Firstly, the front and rear plate portions each rest on an elastic pad. The pads are visible in FIG. 2, where they have the reference numerals 14 and 15. These could be, for example, small plates made of an elastomer. They are preferably located in the support plate zone of the retaining elements, i.e., at the front and rear of the front and rear plate portions, respectively. In addition to the elevation of the plate portions, they create a filtering effect between the plate portions and the ski.

Furthermore, the plate portions are each supported by two lateral wings that are provided to extend down along the ski edges along the side surfaces of the ski. The wings are set back with respect to the plate ends, i.e., their overall length is less than the length of the plate along a longitudinal direction. In this manner, the wings concentrate the forces transmitted between the plate and the ski along the median part of the middle zone of the ski.

Figure 2:
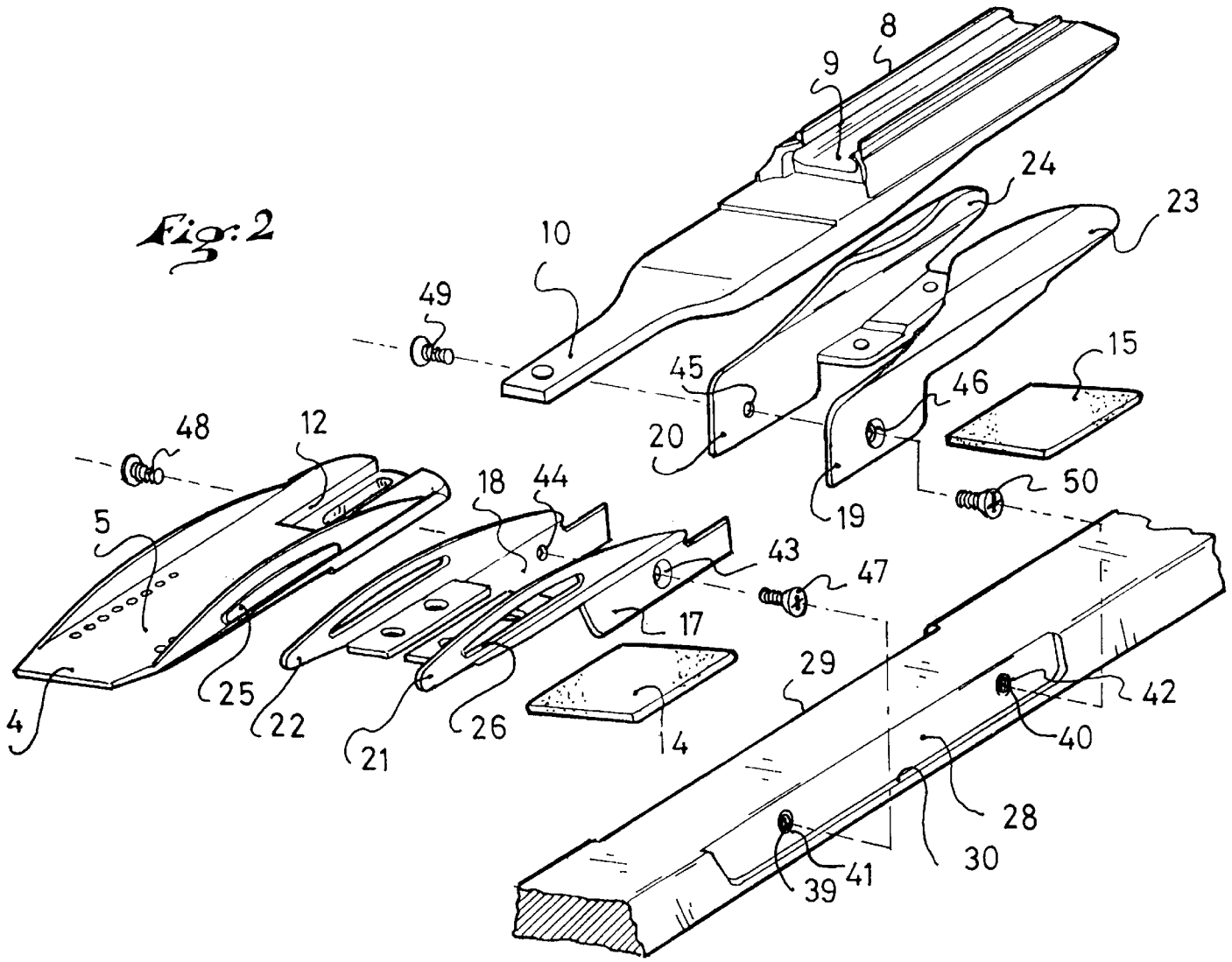
FIG. 2 is an exploded view of the elements of FIG. 1.

Thus, with reference to FIGS. 1 and 2, the front portion of the plate is supported by two lateral wings 17 and 18, and likewise, the rear portion 9 is supported by the wings 19 and 20. The wings are preferably located at the height of the front and rear support plates of the boot retaining elements along a longitudinal direction, i.e., in the front and rear zones of the front and rear plate portions, respectively.

According to the drawings, the wings are the lower attached support elements 21, 22, 23, 24 that are affixed two by two to the front and rear portions 4 and 8. The supports can be made of any appropriate material, especially metal, aluminum alloy or other, or of a plastic material, reinforced or non-reinforced with fibers. Any appropriate means could suffice to affix the supports to the plate portions, for example, as can be seen in FIG. 2, the supports have tabs that are engaged beneath the plate portions, with openings provided for the binding screws. For the front portion, FIG. 2 also represents a sort of projecting lateral ear 25 that is provided to be engaged in an opening 26 of the support, whose shape and dimensions are adjusted. For the rear portion, FIG. 2 shows supports whose upper portion closes above the rear portion, the rear portion having a recumbent "C" shaped section, open upwardly and provided to receive the slide of the rear retaining element. Other means to affix the supports to the plate portions could also suffice, for example, the supports could be assembled via adhesion or welding onto the plate portions.

This constructional embodiment is not restrictive either, and the wings could also be made in one piece with the front and rear plate portions.

Like the pads, the wings preferably extend along the rear part of the front portion, and along the front part of the rear portion so as to realign the linkage zone between the plate and the ski, and to leave the two ends of the ski raised and without any linkage that would maintain it rigidly to the ski. However, one can envision wedging an elastically compressible elastomer block between one and/or the other of the two ends and the ski, so as to control movements with a large amplitude of the ends of the ski, or to prevent the ski from violently striking the rear of the rear part or the front of the front part when there is substantial bending.

The wings are provided to extend down along the lateral side edges of the ski. For example, as can be seen in FIG. 2, towards the center of its middle part, the ski has two recesses, or recessed portions, 28 and 29, one in the area of each lateral side surface. These recesses are provided to receive the wings 17, 18, 19, 20. One could also have four recesses, one for each wing. This type of construction allows avoiding projecting elements along the edges of the ski, which would reduce its edge gliding and behavior of the ski in turns.

In the area of the running edges, the recesses create a flange just above the running edge. Only the flange 30 can be seen in FIGS. 1 and 2. Preferably, the wings do not take support against these flanges and stop a little above them so as avoid direct contact with the running edges.

The wings are provided to be pressed against the lateral walls of the ski formed by the upwardly bottom extending surfaces of the recesses. The wings and these walls are substantially vertical, i.e., perpendicular to the gliding surface of the ski. This is not restrictive, and these surfaces could also be slightly inclined in a converging manner towards the top of the ski, so as to fit conically in the linkage between the wings and the walls of the ski.

According to the invention, the wings are connected to the ski structure via binding journal elements. That is to say that instead of a fixed linkage of the plate or the supports to the ski, the linkage between the plate and the ski is obtained here by a journal that connects each wing to the ski structure. This journal allows a relative rotation between the ski and the supports about the transverse linkage axis that it defines. The filtering pads do not resist this relative rotation; on the contrary, they contribute to the freedom of the ski. The recesses 28 and 29 and their flanges are also provided to allow such a movement. Preferably, this journal element is located in the vicinity of the neutral plane of the ski. Thus, the plate is raised with respect to the ski, it has no fixed linkage with the upper surface of the ski, and it is connected to the ski along two transverse linkage axes that extend through the ski structure towards its neutral plane. Along a longitudinal direction, the linkage axes are located in the area of the wings, i.e., at the height of the pads 14 and 15, and the support plates of the retaining elements. The ski is thus free along a greater length. As can be seen, the openings would be spaced apart a distance less than the length of a boot that would be supported on the support plate 3. The longitudinal position of the linkage axes with respect to the support plates is not restrictive. Depending on the degree to which the pressure is recentered towards the middle of the ski, or conversely, the degree to which it is spread out, the axes can be located more towards the interior, or conversely, towards the exterior with respect to the support plates. It is also freed from the recovery torque of the bindings when the ski bends. Moreover, since the linkage axes are located beneath the upper surface of the ski, they are closer to the neutral plane, and as a result, the relative movements between the wings and the ski are of a very small amplitude.

Figure 3:
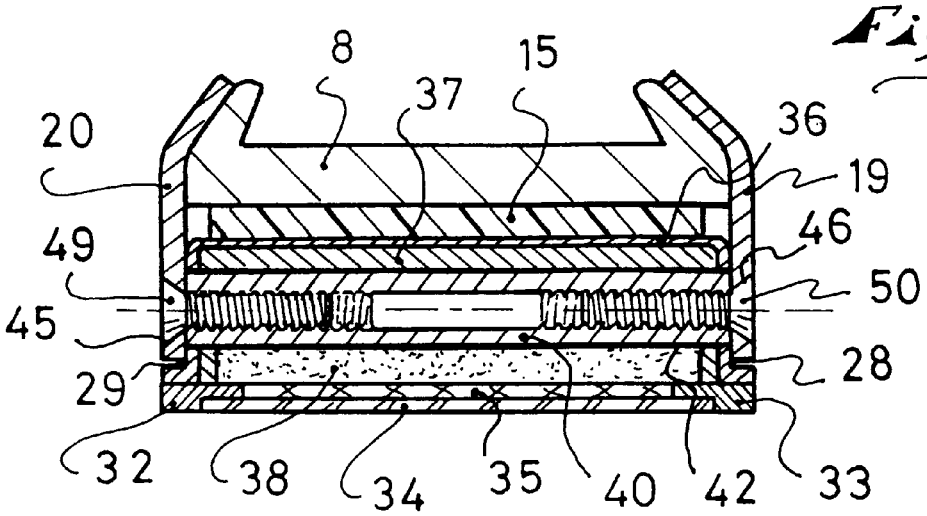
FIG. 3 is a transverse cross-sectional view of the assembly of FIG. 1 in the area of the rear linkage axis.

A first embodiment is seen in FIGS. 1 through 3, FIG. 3 being a cross-sectional view of the assembly of the rear supports to the ski. In a known manner, the ski has a gliding sole 34 topped with a lower reinforcement layer 35 between the two lower running edges 32 and 33. On top, the ski has an outer shell 36 that extends down laterally to the running edges, and an upper reinforcement 37, located beneath the shell and also extending down to the running edges. Between the lower and upper reinforcement layers 35 and 37, the ski structure has a core 38, which is of any appropriate type. Other ski structures could also suffice. There could especially be several lower and/or upper reinforcement layers.

FIG. 3 also shows the two lateral recesses 28 and 29 in which the wings of the two rear supports 19 and 20 are housed; it also shows the filtering pad 15, and the rear portion 8 of the plate.

A traversing insert 40 extends through the ski structure from side to side, opening out on each ski edge at the level of the lateral surfaces of the recesses 28 and 29. In this way, the insert extends through the two lateral side edges of the upper reinforcement layer 37.

Preferably, the traversing insert is also flush with the lower surface of the upper reinforcement layer 37, i.e., vertically upwardly, it bears directly on the upper layer 37.

The traversing insert 40 is threaded at each of its ends.

A second traversing insert 39, of the same type as the insert 40, also extends through the ski in the area of the front supports. The inserts are of any suitable material, for example, aluminum alloy, steel or plastic material. For their assembly into the ski, the ski is first bored with two openings 41, 42, and then the traversing inserts are attached into the borings 41, 42. The inserts can also be placed in the mold when the ski is manufactured.

Across from the insert openings, each of the wings has an opening 43, 44, 45, 46. Screws 47, 48, 49, 50 are screwed into the inserts and ensure the connection of the supports to the ski.

Preferably, the openings 43 through 47 are countersunk at their openings, and the screws 47 through 50 have countersunk heads. The vertical position of the openings 43 through 46 is moreover provided in such a way that the axes of the openings is slightly raised with respect to the axes of the inserts when the plate and the supports are merely placed on the ski with the intermediate pads. In this way, by taking position in their housings, the countersunk heads of the screws 47 through 50 force the supports to come down, thus causing a slight compressive pre-tension and a pinching of the pads 14 and 15. This promotes a good linkage between the retaining elements and the ski for the transmission of lateral supports. Any other appropriate means to establish this pinching could also suffice. Additionally, pre-tensing is preferred but not indispensable.

Each insert with its two binding screws defines a linkage axis of the plate to the ski. The screws are the journal assembly elements insofar as they allow a relative rotation of the wings and the ski about the linkage axis.

Good results were obtained on an experimental basis with the type of construction shown in FIGS. 1 through 3, by using transversing inserts having a 6 mm diameter and threaded internally for 5 mm screws.

Figure 4:
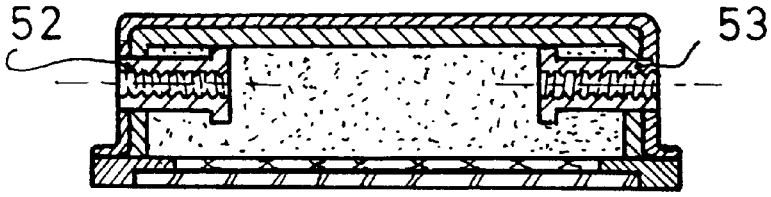
FIGS. 4 and 5 are constructional variations of the ski.

FIG. 4 represents a variation where the traversing insert is substituted via two simple inserts 52 and 53 that are embedded in the core, and that open out on the side of each side edge of the ski.

Figure 5:
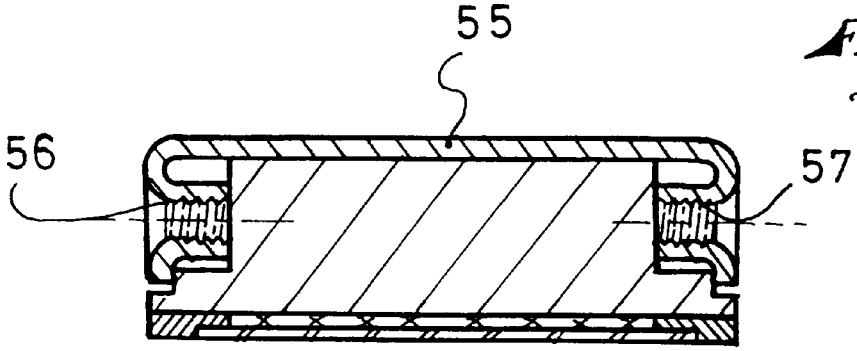

FIG. 5 relates to another variation. A clamp 55 made of aluminum or another equivalent material is affixed to the upper surface of the ski in the zone of the wings, for example, via screws. The clamp has two lateral side edges that extend down along the edges of the ski. The sides have threaded openings 56 and 57, that are made via any suitable means, especially via a flow drilling technique or another equivalent technique, that achieves the boring by forming a chimney-like portion, which is then threaded.

According to FIG. 5, a lateral cut-out is provided for the clamp edges, but it is not deep enough to house the wings. In this regard, the depth of the cut-outs is not restrictive.

The other linkage axis is obtained with a clamp that is similar to clamp 55. Both clamps are independent of each other, or they can be connected by a linkage tongue or other. In this case, the linkage is preferably flexible so as not to hinder the bending of the ski.

According to an alternative embodiment, instead of being assembled via screws, the clamp is assembled via welding, i.e., it is made from a material that is melted with the outer coating of the ski, or it is coated with such a material. The clamp is welded to the ski, for example, according to a vibration welding technique, such as disclosed in the commonly owned French Patent Publication 2 659 865.

Instead of having borings, the clamp could have projecting threaded end pieces, or any other appropriate affixing means.

Figure 6:
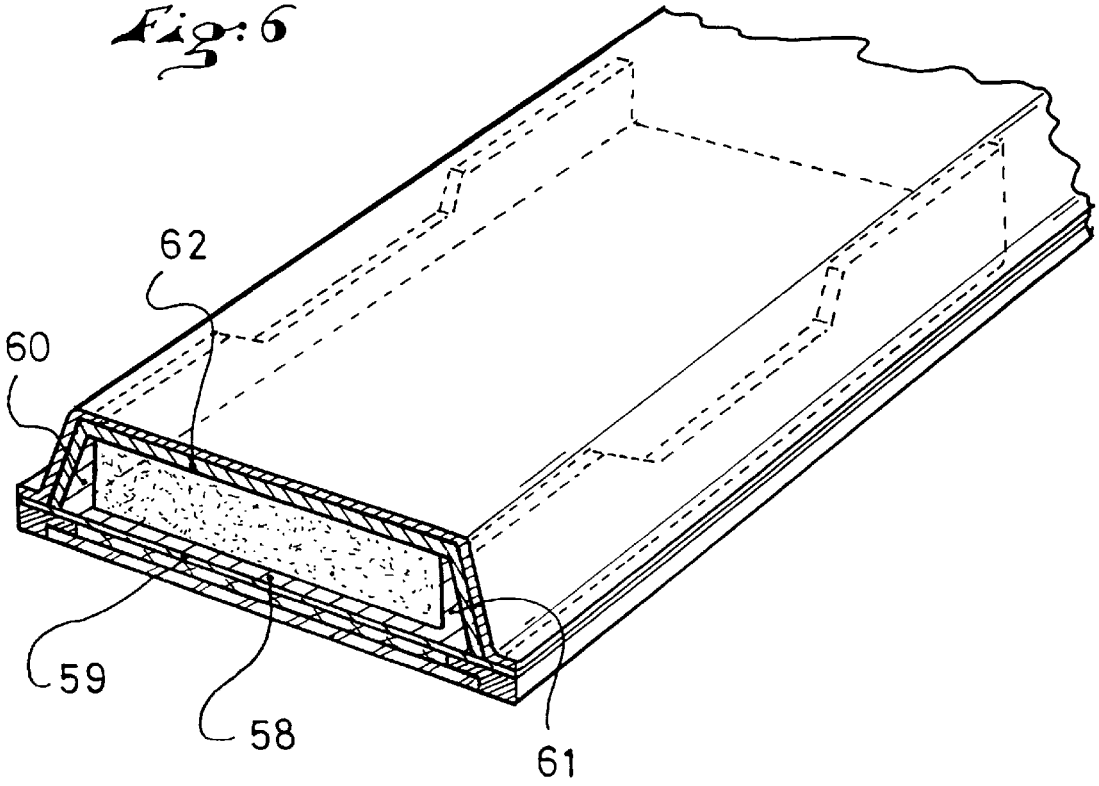
FIGS. 6 and 7 schematically show other constructional variations of the ski.

According to the constructional variation of FIG. 6, a reinforcement 58, either metallic or made of a plastic material, is inserted during the ski construction towards the center of its middle zone. This reinforcement has a "U" shaped cross-section, whose base takes support against the lower layer 59 of the reinforcement, and the two wings 60, 61 extend along the ski edges. Preferably, the upper parts of the wings are flush with the upper reinforcement layer 62, at least locally in the zones of the linkage axes.

Such a ski is equipped with inserts like the inserts 39, 40. One could avoid the inserts altogether by using self-threading screws, and by boring the ski at a diameter lesser than the screw diameter, as for a traditional assembly of a retaining element on a ski.

Figure 7:
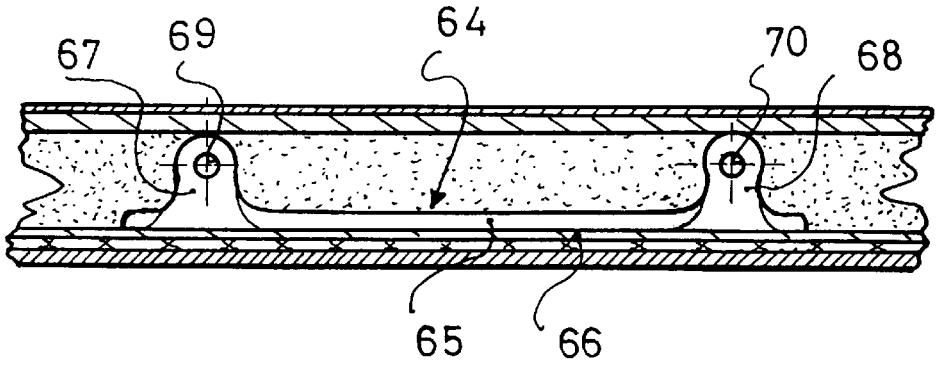

FIG. 7 relates to another variation according to which a reinforcement 64 is also introduced into the ski structure when it is manufactured. The reinforcement has a plate 65 that rests against the lower reinforcement layer 66 and, in the area of the two linkage axes, a transverse projection 67, 68. Each of the projections is bored with a transverse opening 69, 70. Towards the top, the projections preferably bear against the upper reinforcement layer 71. In addition, the projections extend transversely along the entire width of the ski, or only along two segments located against each of the edges. The openings 69 and 70 can be threaded at the outset, or threaded by the binding screw during the screwing process, as with the previous inserts.

Figure 13:
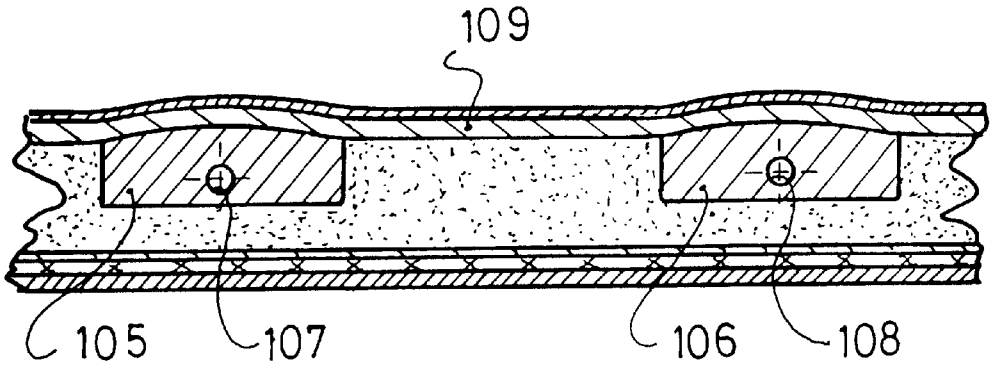
FIG. 13 represents a constructional variation of the ski.

According to FIG. 13, the ski is made with two transverse reinforcements 105 and 106, that bulge on top and are located beneath the upper reinforcement layer 109. These reinforcements are made of aluminum, or a fiber reinforced plastic material, for example. They are each bored with an opening 107, 108, provided for the journal, for example, screws. The screws can be assembled with an insert, or they can be directly screwed into the reinforcements. Such a construction allows ensuring a good retention of the screws, and a good distribution of the forces along the upper reinforcement layer in case of traction on the bindings. Additionally, these reinforcements can be used for skis with small thicknesses.

Other variations could also be used. For example, instead of being pressed against the edges of the ski, the wings could be engaged in the longitudinal grooves obtained in the ski structure, from the top.

Figure 8:
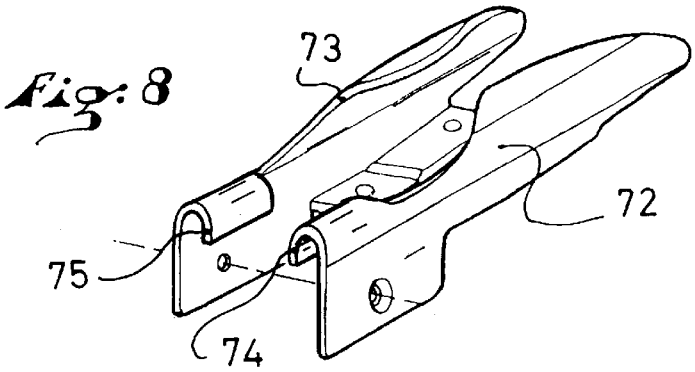
FIG. 8 shows an embodiment variation of the supports.

FIG. 8 relates to a variation for the supports. According to this variation, the supports 72 and 73 have a return 74, 75 provided to rest against the upper surface of the ski, in the direction of the other pair of supports. These supports have a stabilizing effect and block the rotation of the supports in the direction in which they take support against the ski.

In a variation, the returns could be substituted by support elements that originate from the rear portion of the plate.

Figure 9:
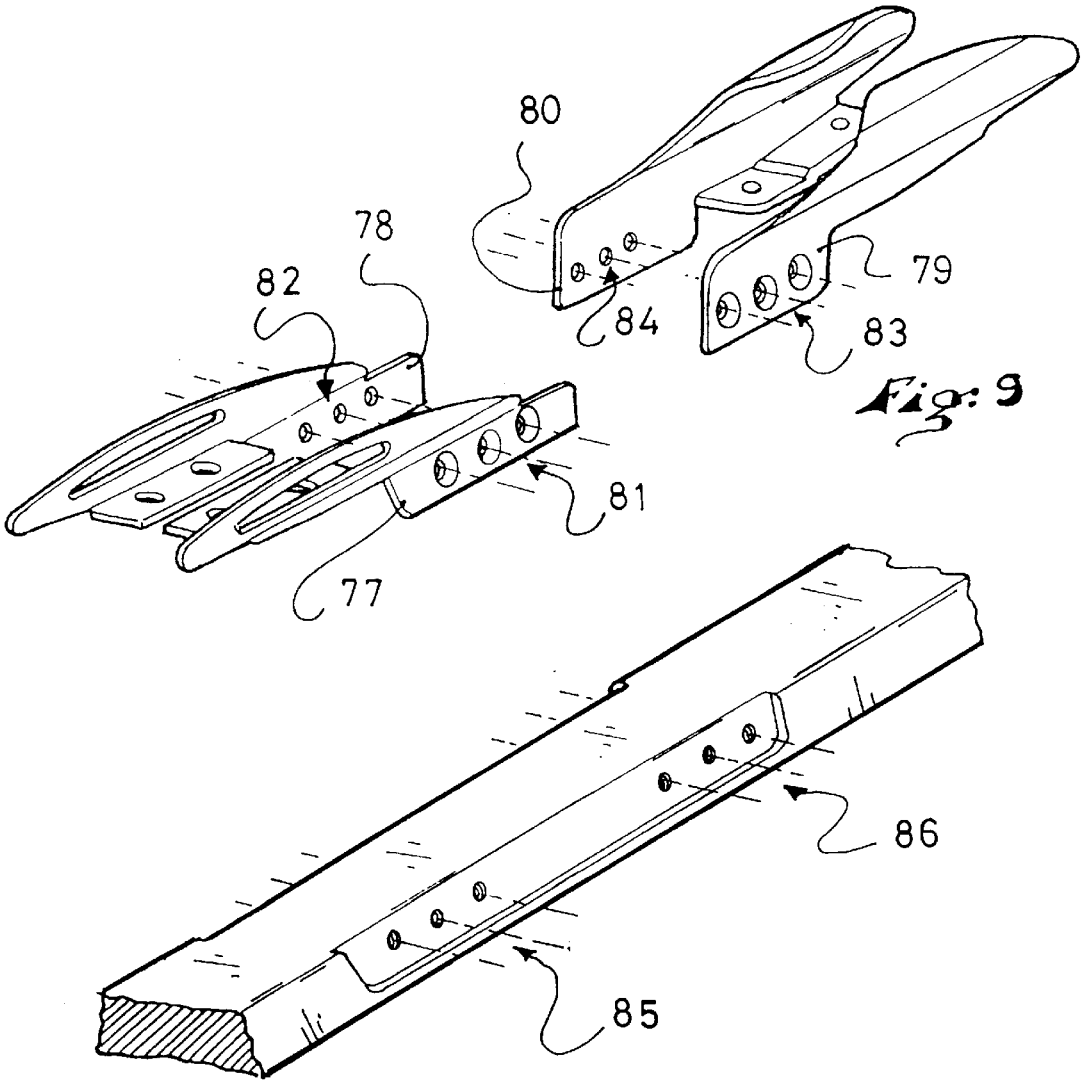
FIG. 9 is an exploded view relative to another embodiment of the invention.

Another variation is shown schematically in FIG. 9. Each wing 77, 78, 79, 80 is bored with a series of assembly openings 81, 82, 83, 84 distributed along the longitudinal direction. The ski is also bored with two series of openings 85, 86, each of them being equipped, as necessary, with an insert or other appropriate means.

A screw or other appropriate equivalent is used to assemble each wing to the ski. The series of holes allows the wings to be mounted in different longitudinal positions, depending on the length of the boot and, if necessary, by also adjusting the variable length of the linkage between the two plate portions. They also allow selecting the position of the linkage axes on the ski, through which the forces between the ski and the boot are transmitted. In other words, it is possible to more or less bring the two linkage axes closer to one another, and to offset them towards the front or the rear. This characterizes the ski in wide or tight turns. It should be noted that in this embodiment, the invention provides for only one screw or other journal per wing.

Figure 10:
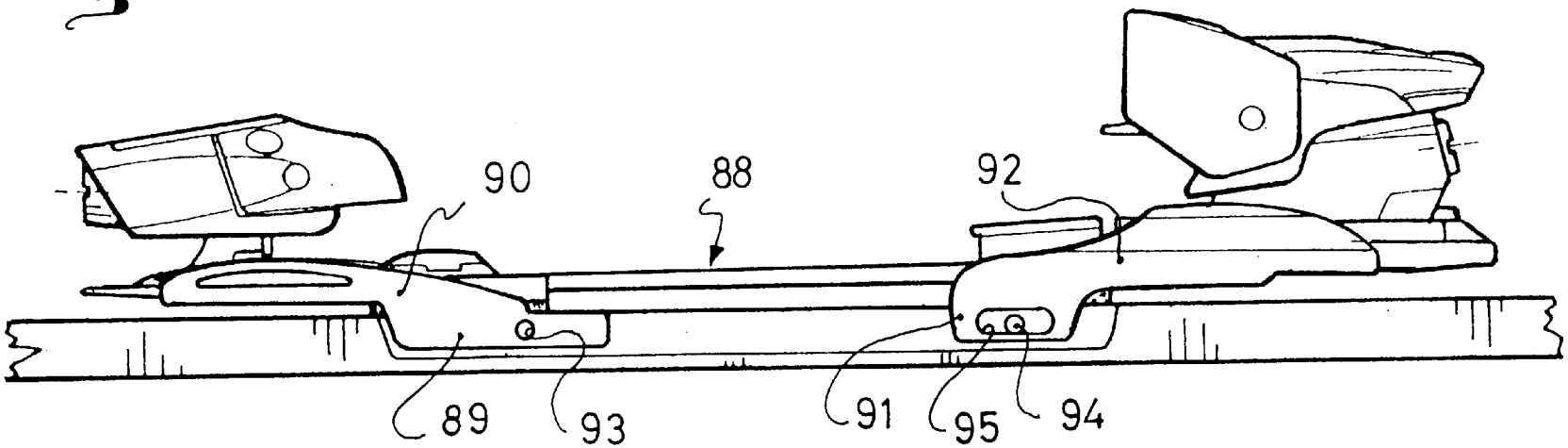
FIGS. 10 through 12 represent additional embodiments of the invention.

FIG. 10 depicts another embodiment of the invention. The plate 88 is connected to the ski by the wings 89 and 91 of the supports 90 and 92. One of the linkage axes of the wings to the ski is embodied as a journal binding element 93, for example, a screw. The other linkage axis is floating. Thus, according to the figure, the rear journal 94 extends through the rear wings in the area of a slot 95. The slot could also be placed at the front.

Figure 11:
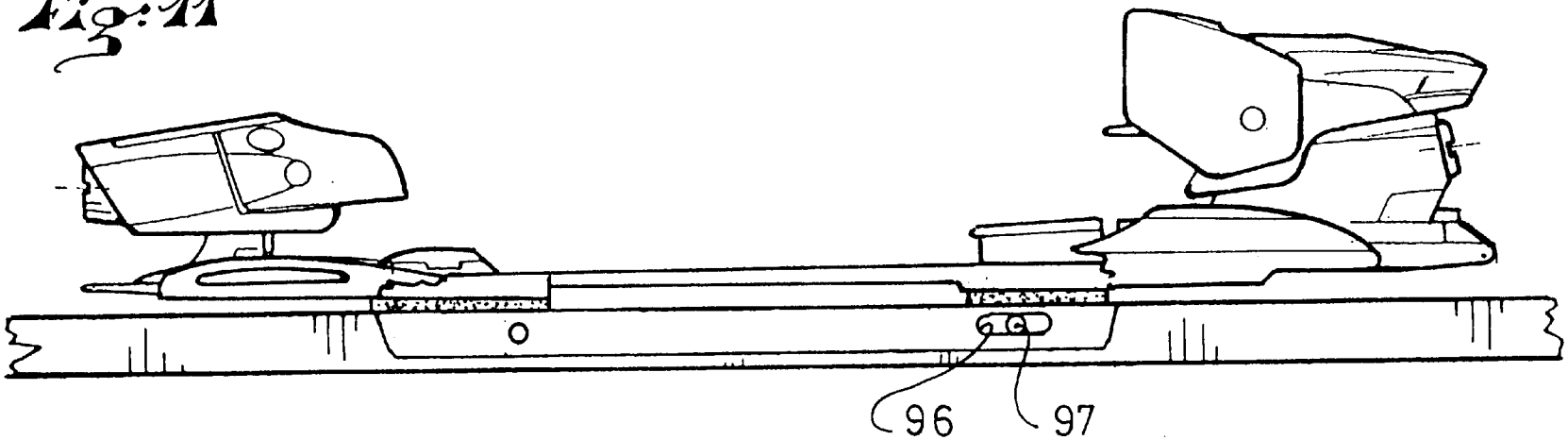

FIG. 11 embodies a variation where it is the ski that has a slot 96 towards the rear for the rear journal 97. In this figure, the supports have been removed to show the rear slot. The free space between the rear journal 97 and the ends of the slot 96 could be filled with blocks of shock absorbing material.

Figure 12:
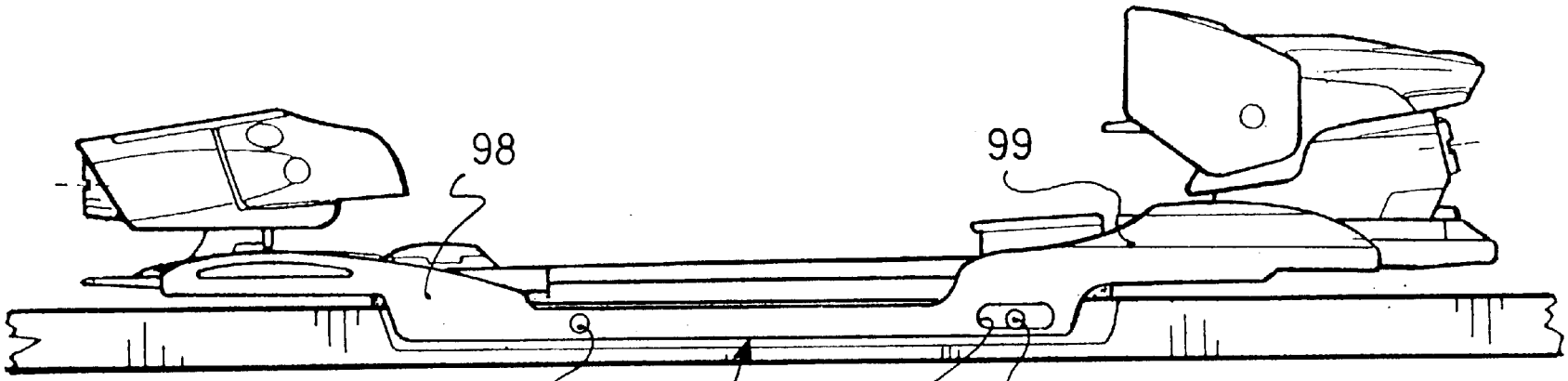

According to the embodiment represented in FIG. 12, the front wings 98 and the rear wings 99 are the front and rear parts of a continuous frame plate 100. The front support forms one piece with the rear support.

As was the case in FIG. 10, the front linkage axis is embodied as a journal 101, and the rear connecting axis is floating. FIG. 12 shows a free journal 102 in a slot 103 of the wings. The slot could also be located in the ski as has been shown in FIG. 11.

The instant description has only been provided by way of example, and other embodiments of the invention could be envisioned without leaving the scope thereof.

In particular, it is not essential for the linkage axes to be precisely transverse, i.e., perpendicular to the longitudinal direction of the ski. The position of both the journal located on both sides of the ski could be offset longitudinally, so that the linkage axis becomes oblique with respect to the longitudinal direction of the ski. This angular offset could be carried over, but in an inverse manner on the other ski. It could create an elastic return effect for the front and rear parts of the ski when the ski bends, and promote the lateral deformation of the ski during edge setting. In this way, it becomes possible to promote the ski's curve grip in a turn by concentrating the supports more on one side than the other of the ski.

Other variations could also be envisioned as regards the journal bindings. As has already been stated, their longitudinal position on the ski could be different from what has been described, i.e., instead of being located towards one end of the front and rear plate portions, the wings could be located more towards the center of the plate.

One could also envision filtering spacers between the linkage axes or screws and the wings.

For example, one could bore the wings at a diameter that is greater than the diameter of the axis or the screw, and insert a spacer or a stepped washer between the axis or the screw and the wing. This washer could be made of suitable material, and would form a filtering spacer between the body, the axis or the screw and the inside of the wing hole, and possibly between the screw head and the outer wall of the wing.

Finally, the invention could find an application in all types of skis, including those skis that have wasp-waisted side cuts, wide skis and short skis whose length is comprised between 0.50 and 1.50 meters.

What is claimed is:

1. An interface device comprising a plate with a front portion having a mounting zone provided for a front retaining element, a rear portion having a mounting zone provided for a rear retaining element, a non-extensible linkage between the two front and rear portions, each of the portions have two lateral sides and a lower wing on each side, the lower wings of each portion standing back with respect to the end of said portion, and the wings being provided to be pressed against a lateral side edge of the ski, and the wings of each plate portion having a single journal element for binding the wings to the ski.

2. An interface plate according to claim 1, wherein each wing has at least one opening for a binding journal element.

3. An interface device according to claim 2, wherein the wings bear a series of openings, each provided for a single binding journal element.

4. An interface device according to claim 2, wherein a part of the wings has an elongated opening.

5. An interface device according to claim 1, further comprising upwardly extending support elements affixed to and supporting the front and rear portions of said plate, wherein the wings are lower parts of the support elements.

6. An interface device according to claim 5, wherein the support elements located on the same side of the plate constitute a single element and wherein their wings are the front and rear parts of a continuous frame.

7. A ski equipped with an interface device comprising a plate that is raised with respect to an upper surface of the ski, with a front portion having a mounting zone provided for a front retaining element, a rear portion with a mounting zone provided for a rear retaining element, a non-extensible linkage between the two front and rear portions, wherein said ski has in its middle sliding skid zone a zone where its two lateral side edges are substantially parallel, each of the plate portions being connected to the ski via two lower wings that extend beneath the plate and are set back with respect to the end of the plate portion, both wings being pressed against the lateral side edges of the ski, and each wing being fixed to the ski via a single binding journal element.

8. A ski equipped according to claim 7, wherein the front and rear ends of the plate are raised without being held rigidly with respect to the upper surface of the ski.

9. A ski according to claim 8, wherein the plate is kept raised via two filtering pads located along the plate at the height of the wings.

10. An interface device adapted to be positioned between a ski and bindings for retaining a boot on the ski, said interface device comprising:

a plate assembly having a front portion with a mounting zone adapted to support a front binding, and a rear portion with a mounting zone adapted to support a rear binding;

said front and rear portions of said plate assembly being connected to each other by a non-extensible connection;

said front portion having a forwardmost end and said rear portion having a rearwardmost end, each of said front and rear portions having respective downwardly extending laterally spaced apart wings, said wings of said front portion being set back from said forwardmost end and said wings of said rear portion being set back from said rearwardmost end, each of said wings being adapted to be applied to a lateral side surface of the ski;

each of said wings having only a single journal connection between said interface device and said ski.

11. An interface device according to claim 10, wherein:

each said wing has at least one opening, a single journal element of a respective one of said journal connection extending through said opening.

12. An interface device according to claim 11, wherein:

said wings comprises a series of openings, each series of openings being provided for said single journal element.

13. An interface device according to claim 11, wherein:

said laterally spaced apart wings of one of said front and rear portions of said plate assembly has elongated openings, each of said elongated openings having extending therethrough a respective one of said single journal elements.

14. An interface device according to claim 10, wherein:

said plate assembly include a plurality of support elements for supporting said front and rear portions, said wings constituting lowermost parts of said support elements.

15. An interface device according to claim 14, wherein:

on each respective lateral side of said plate assembly, said support elements are constituted by a single unitary continuous frame, said wings on each said respective lateral side of said plate assembly comprising front and rear parts of said continuous frame.

16. An interface device according to claim 10, wherein:

each of said laterally spaced apart wings of each of said front and rear portions have parallel internal surfaces adapted to face the ski.

17. In combination, a ski and an interface device to support bindings to retain a boot on the ski, said combination comprising:

a ski comprising an upper surface, a middle sliding zone, and substantially parallel opposite lateral side surfaces in said middle sliding zone; and an interface device comprising:

a plate assembly having a front portion with a mounting zone adapted to support a front binding, and a rear portion with a mounting zone adapted to support a rear binding, said front and rear portions having opposite longitudinal ends spaced above said upper surface of the ski;

said front and rear portions of said plate assembly being connected to each other by a non-extensible connection;

said front portion having a forwardmost end and said rear portion having a rearwardmost end, each of said front and rear portions having respective laterally spaced apart wings extending downwardly from said mounting zones, said wings of said front portion being set back from said forwardmost end and said wings of said rear portion being set back from said rearwardmost end, said laterally spaced apart wings of each of said front and rear portions being connected to respective ones of said opposite lateral side surfaces of said ski;

each of said wings having only a single journal connection between said interface device and said ski.

18. The combination according to claim 17, wherein:

said front and rear portions of said plate assembly are not directly connected to said upper surface of said ski.

19. The combination according to claim 18, wherein:

said front and rear portions of said plate assembly are raised above said upper surface of said ski by means of two filtering pads located along said plate assembly at the height of the wings.

20. The combination according to claim 19, wherein:

said filtering pads are made of an elastomer.

21. The combination according to claim 17, wherein:

said longitudinal ends of said front and rear portions of said plate assembly are mounted for relative movement with said upper surface of said ski by means of said journal connections.

22. An interface device adapted to be positioned between a ski and bindings for retaining a boot on the ski, said interface device comprising:

a front binding support portion having a mounting zone adapted to support a front binding, and a rear binding support portion having a mounting zone adapted to support a rear binding;

said front and rear binding support portions being connected to each other by a non-extensible linkage;

said front binding support portion having a forwardmost end and said rear binding support portion having a rearwardmost end, each of said front and rear binding support portions having respective downwardly extending laterally spaced apart wings, said wings of said front portion being set back from said forwardmost end and said wings of said rear portion being set back from said rearwardmost end, each of said wings being adapted to be applied to a lateral side surface of the ski;

each of said wings having only a single journal connection between said interface device and said ski.

23. An interface device according to claim 22, wherein:

each of said laterally spaced apart wings of each of said front and rear binding support portions have parallel internal surfaces adapted to face the ski.

24. An interface device according to claim 22, wherein:

said non-extensible linkage is flexible for allowing flexion of the ski in a vertical and longitudinal plane.

25. An interface device according to claim 22, wherein:

said non-extensible linkage comprises a contractive, non-extensible connection, opposing an extension movement between said front and rear plate portions, but allowing a contractive movement between said front and rear plate portions.

26. In combination, a ski and an interface device to support bindings to retain a boot on the ski, said combination comprising:

a ski comprising an upper surface, a middle sliding zone, and substantially parallel opposite lateral side surfaces in said middle sliding zone; and an interface device comprising:

a front portion with a mounting zone adapted to support a front binding, and a rear portion with a mounting zone adapted to support a rear binding, said front and rear portions having opposite longitudinal ends spaced above said upper surface of the ski;

said front and rear portions being connected to each other by a non-extensible linkage;

said front portion having a forwardmost end and said rear portion having a rearwardmost end, each of said front and rear portions having respective laterally spaced apart wings extending downwardly from said mounting zones, said wings of said front portion being set back from said forwardmost end and said wings of said rear portion being set back from said rearwardmost end, said laterally spaced apart wings of each of said front and rear portions being connected to respective ones of said opposite lateral side surfaces of said ski;

each of said wings having only a single journal connection between said interface device and said ski.

27. The combination according to claim 26, wherein:

said non-extensible linkage is flexible for allowing flexion of the ski in a vertical and longitudinal plane.

28. The combination according to claim 26, wherein:

said non-extensible linkage comprises a contractive, non-extensible connection, opposing an extension movement between said front and rear portions, but allowing a contractive movement between said front and rear portions.

* * * * *